US009392915B1

(12) United States Patent
Jones

(10) Patent No.: US 9,392,915 B1
(45) Date of Patent: Jul. 19, 2016

(54) AIR FRESHENING TOILET SEAT DEVICE

(71) Applicant: Emmanuel Jones, Oxford, NC (US)

(72) Inventor: Emmanuel Jones, Oxford, NC (US)

( * ) Notice: Subject to any disclaimer, the term of this patent is extended or adjusted under 35 U.S.C. 154(b) by 149 days.

(21) Appl. No.: 14/163,154

(22) Filed: Jan. 24, 2014

(51) Int. Cl.
*E03D 9/00* (2006.01)
*A47K 13/30* (2006.01)

(52) U.S. Cl.
CPC .. *A47K 13/30* (2013.01); *E03D 9/00* (2013.01)

(58) Field of Classification Search
CPC ..... E03D 9/007
USPC ..... 4/222–233
See application file for complete search history.

(56) References Cited

U.S. PATENT DOCUMENTS

| | | | | |
|---|---|---|---|---|
| 713,977 | A | | 11/1902 | Gallagher |
| 866,400 | A | | 9/1907 | Stevens |
| 191,106 | A | | 8/1961 | Delano |
| 3,088,125 | A | * | 5/1963 | Southwood ..... 4/222 |
| 3,316,559 | A | * | 5/1967 | Ewing et al. ..... 4/223 |
| 4,358,860 | A | * | 11/1982 | Church ..... 4/228.1 |
| 4,577,350 | A | | 3/1986 | Clark |
| 5,383,237 | A | * | 1/1995 | Baker ..... 4/237 |
| 5,954,269 | A | * | 9/1999 | Bolze ..... 239/70 |
| 6,081,935 | A | * | 7/2000 | Kishi et al. ..... 4/222 |
| 6,178,563 | B1 | * | 1/2001 | Helfet ..... 4/213 |
| 6,330,723 | B1 | * | 12/2001 | Orgias ..... 4/237 |
| 6,804,837 | B1 | * | 10/2004 | Guess, Sr. ..... 4/213 |
| 7,676,856 | B1 | * | 3/2010 | Graham, II ..... 4/228.1 |
| 7,987,527 | B1 | * | 8/2011 | Shumaker ..... 4/213 |
| 2007/0067897 | A1 | * | 3/2007 | Graham, II ..... 4/228.1 |
| 2007/0204388 | A1 | * | 9/2007 | Zyskowski et al. ..... 4/228.1 |
| 2009/0307831 | A1 | * | 12/2009 | Shahar ..... 4/216 |

* cited by examiner

*Primary Examiner* — Lori Baker

(57) ABSTRACT

An air freshening toilet seat device dispenses air freshener through a toilet seat. The device includes a toilet seat and a channel extending through the toilet seat. A plurality of apertures extends through the toilet seat. Each of the apertures is in fluid communication with the channel. An air freshener is held in a reservoir. A pump is coupled to the toilet seat. The pump is in fluid communication with the channel and the reservoir wherein the air freshener is dispensable through the apertures when the pump is manipulated.

11 Claims, 3 Drawing Sheets

AIR FRESHENING TOILET SEAT DEVICE

BACKGROUND OF THE DISCLOSURE

Field of the Disclosure

The disclosure relates to toilet seat devices and more particularly pertains to a new toilet seat device for dispensing air freshener through a toilet seat.

SUMMARY OF THE DISCLOSURE

An embodiment of the disclosure meets the needs presented above by generally comprising a toilet seat and a channel extending through the toilet seat. A plurality of apertures extends through the toilet seat. Each of the apertures is in fluid communication with the channel. An air freshener is held in a reservoir. A pump is coupled to the toilet seat. The pump is in fluid communication with the channel and the reservoir wherein the air freshener is dispensable through the apertures when the pump is manipulated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
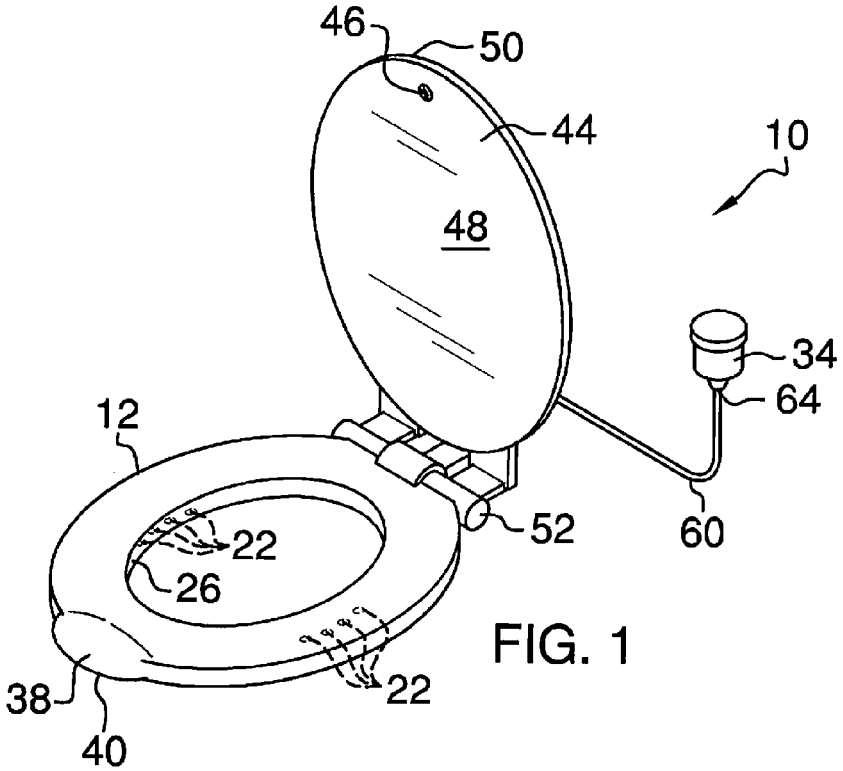
FIG. 1 is a top front side perspective view of a air freshening toilet seat device according to an embodiment of the disclosure.
Figure 2:
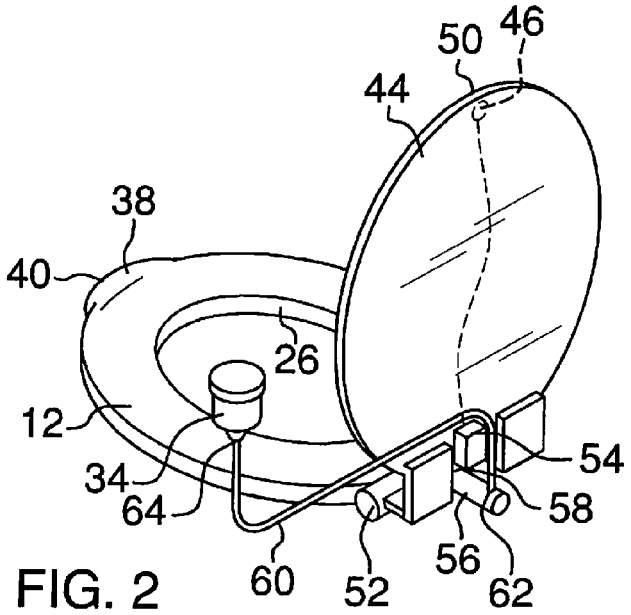
FIG. 2 is a top back side perspective view of an embodiment of the disclosure.
Figure 3:
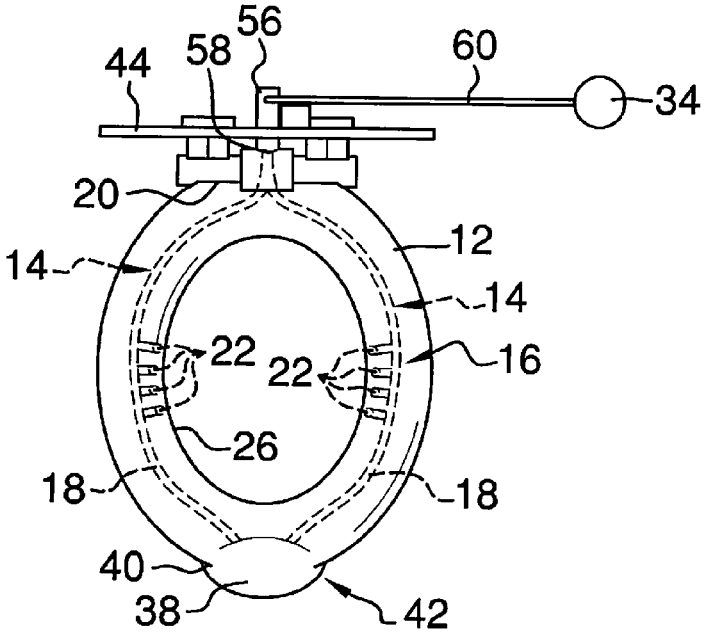
FIG. 3 is a top view of an embodiment of the disclosure.
Figure 4:
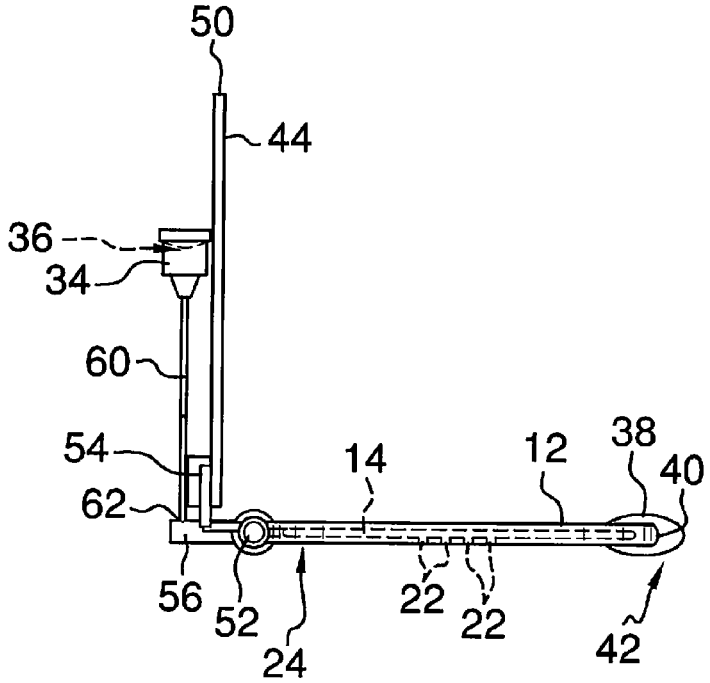
FIG. 4 is a side view of an embodiment of the disclosure.
Figure 5:
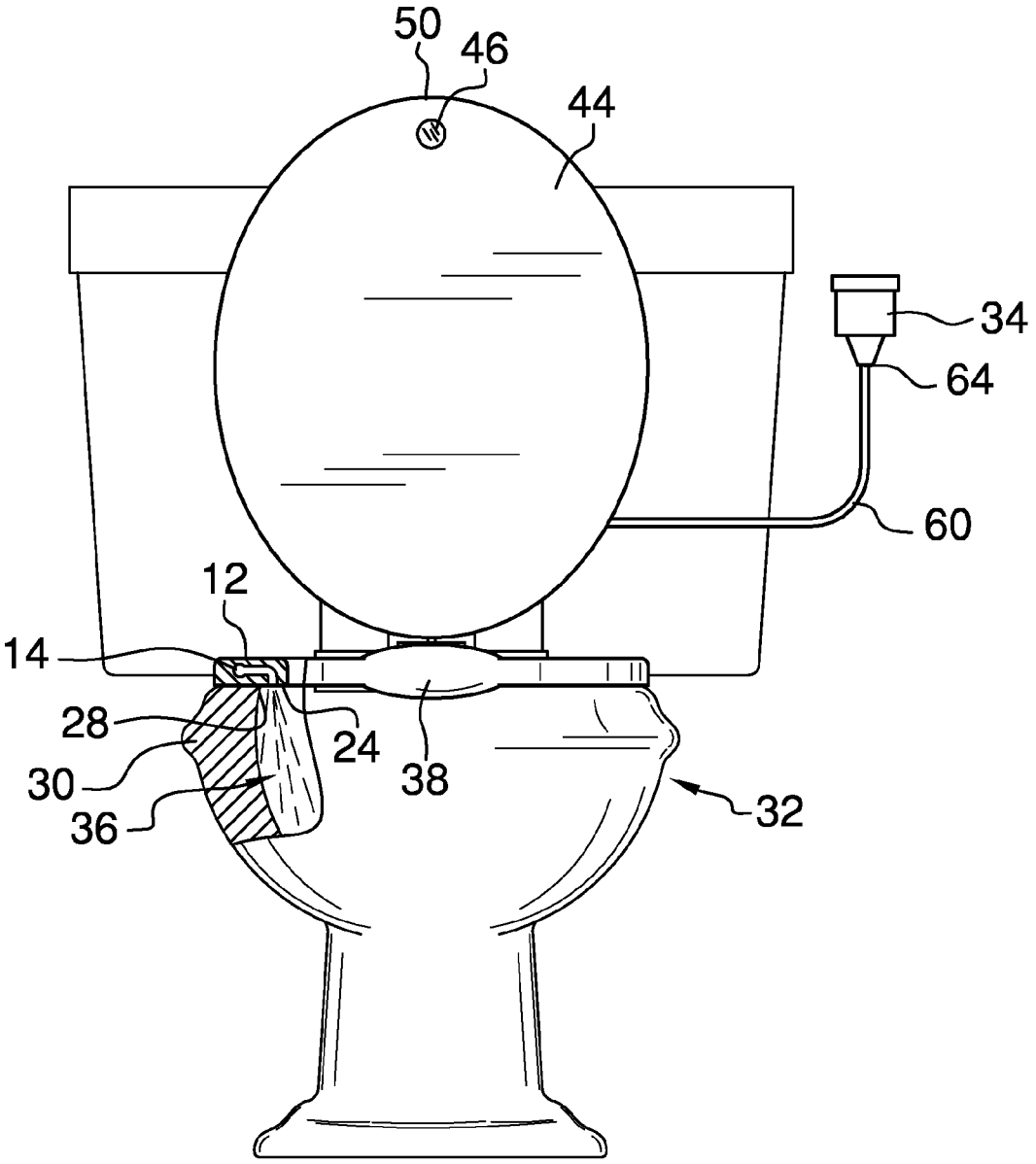
FIG. 5 is a partial cut-away front view of an embodiment of the disclosure in use.

With reference now to the drawings, and in particular to FIGS. 1 through 5 thereof, a new toilet seat device embodying the principles and concepts of an embodiment of the disclosure and generally designated by the reference numeral 10 will be described.

As best illustrated in FIGS. 1 through 5, the air freshening toilet seat device 10 generally comprises a toilet seat 12 which may be annular. A channel 14 extends through the toilet seat 12. The channel 14 extends around the toilet seat 12 proximate a middle 16 of a width of the toilet seat 12. The channel 14 may have a pair of branches 18 extending outwardly and forwardly from a back side 20 of the toilet seat 12. Each of a plurality of apertures 22 extends through the toilet seat 12. Each of the apertures 22 is in fluid communication with the channel 14. Each of the apertures 22 is positioned on a bottom surface 24 of the toilet seat 12. The apertures 22 are inwardly offset from the channel 14 wherein the apertures 22 are positioned proximate an interior edge 26 of the toilet seat 12 wherein each aperture 22 is configured for being positioned overhanging an interior edge 28 of a bowl 30 of a toilet 32.

A reservoir 34 holds an air freshener 36. A pump 38 is coupled to the toilet seat 12 and may be integrally formed in the toilet seat 12. The pump 38 is in fluid communication with the channel 14 and the reservoir 34 wherein the air freshener 36 is dispensable through the apertures 22 when the pump 38 is manipulated. It is contemplated that the pump 38 is manually operated and positioned on a front edge 40 of the toilet seat 12 to be accessible to a person sitting on the toilet seat 12. The pump 38 may form a bulbous portion 42 of the toilet seat 12 to be squeezed when dispensing of the air freshener 36 is desired.

A lid 44 is pivotally coupled to the toilet seat 12 wherein the lid 44 selectively covers the toilet seat 12. A sensor 46 is coupled to a bottom surface 48 of the lid 44. The sensor 46 detects motion wherein the sensor 46 is configured for detecting use of the toilet 32. The sensor 46 is operationally coupled to the reservoir 34 in a conventional manner wherein the air freshener 36 is dispensed from the reservoir 34 through the apertures 22 upon detection of motion by the sensor 46. This may be achieved through a separate second pump (not shown) or through a conventional operational connection to the pump 38. The sensor 46 is positioned on the bottom surface 48 of the lid 44 adjacent to a distal edge 50 of the lid 44 relative to a hinge 52 coupling the lid 44 to the toilet seat 12. Thus, the sensor 46 is positioned to monitor an area occupied by a user of the toilet 32. A battery 54 is electrically coupled to the sensor 46. The battery 54 is coupled to the lid 44 proximate the hinge 52 coupling the lid 44 to the toilet seat 12.

A tube 56 may be provided having a first end 58 in fluid communication with the channel 14. The tube 56 extends rearwardly from the back side 20 of the toilet seat 12. Flexible tubing 60 has a first end 62 coupled to the tube 56. The flexible tubing 60 has a second end 64 coupled to the reservoir 34 wherein the reservoir 34 is in fluid communication with the channel 14. Thus, the reservoir 34 may be extrinsic to the toilet seat 12 and positioned in any desired location near the toilet seat 12.

In use, the air freshener 36 may be distributed either manually by manipulation of the pump 38 or automatically through the activation via the sensor 46 if so equipped. The apertures 22 are downwardly directed and may be structured to provide the air freshener 36 in a mist directed substantially into the bowl 30 of the toilet 32.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An air freshening toilet seat device comprising:

a toilet seat;

a channel extending through said toilet seat;

a plurality of apertures extending through said toilet seat, each of said apertures being in fluid communication with said channel;

a reservoir;

an air freshener being held in said reservoir;

a pump coupled to said toilet seat, said pump being in fluid communication with said channel and said reservoir wherein said air freshener is dispensable through said apertures when said pump is manipulated;

a tube, said tube having a first end in fluid communication with said channel, said tube extending rearwardly from said toilet seat; and flexible tubing having a first end coupled to said tube, said flexible tubing having a second end coupled to said reservoir wherein said reservoir is in fluid communication with said channel, said tube having a second end coupled to said channel.

2. The device of claim 1, further comprising each of said apertures being positioned on a bottom surface of said toilet seat.

3. The device of claim 1, further comprising said pump being positioned on a front edge of said toilet seat.

4. The device of claim 1, further comprising a lid, said lid being pivotally coupled to said toilet seat wherein said lid selectively covers said toilet seat.

5. The device of claim 4, further comprising a sensor, said sensor being coupled to a bottom surface of said lid, said sensor detecting motion wherein said sensor is configured for detecting use of the toilet, said sensor being operationally coupled to said reservoir wherein air freshener is dispensed from said reservoir through said apertures upon detection of motion by said sensor.

6. The device of claim 5, further comprising said sensor being positioned on a bottom surface of said lid.

7. The device of claim 5, further comprising said sensor being positioned adjacent to a distal edge of said lid relative to a hinge coupling said lid to said toilet seat.

8. The device of claim 5, further comprising a battery electrically coupled to said sensor, said battery being coupled to said lid proximate said hinge coupling said lid to said toilet seat.

9. An air freshening toilet seat device comprising:

a toilet seat;

a channel extending through said toilet seat;

a plurality of apertures extending through said toilet seat, each of said apertures being in fluid communication with said channel;

a reservoir;

an air freshener being held in said reservoir;

a pump coupled to said toilet seat, said pump being in fluid communication with said channel and said reservoir wherein said air freshener is dispensable through said apertures when said pump is manipulated; and said toilet seat being annular, said channel extending around said toilet seat proximate a middle of a width of said toilet seat.

10. The device of claim 9, further comprising said apertures being inwardly offset from said channel wherein said apertures are positioned proximate an interior edge of said toilet seat wherein each said aperture is configured for being positioned overhanging an interior edge of a bowl of the toilet.

11. An air freshening toilet seat device comprising:

a toilet seat, said toilet seat being annular;

a channel extending through said toilet seat, said channel extending around said toilet seat proximate a middle of a width of said toilet seat;

a plurality of apertures extending through said toilet seat, each of said apertures being in fluid communication with said channel, each of said apertures being positioned on a bottom surface of said toilet seat, said apertures being inwardly offset from said channel wherein said apertures are positioned proximate an interior edge of said toilet seat wherein each said aperture is configured for being positioned overhanging an interior edge of a bowl of the toilet;

a reservoir;

an air freshener being held in said reservoir;

a pump coupled to said toilet seat, said pump being in fluid communication with said channel and said reservoir wherein said air freshener is dispensable through said apertures when said pump is manipulated, said pump being positioned on a front edge of said toilet seat;

a lid, said lid being pivotally coupled to said toilet seat wherein said lid selectively covers said toilet seat;

a sensor, said sensor being coupled to a bottom surface of said lid, said sensor detecting motion wherein said sensor is configured for detecting use of the toilet, said sensor being operationally coupled to said reservoir wherein air freshener is dispensed from said reservoir through said apertures upon detection of motion by said sensor, said sensor being positioned on a bottom surface of said lid, said sensor being positioned adjacent to a distal edge of said lid relative to a hinge coupling said lid to said toilet seat;

a battery electrically coupled to said sensor, said battery being coupled to said lid proximate said hinge coupling said lid to said toilet seat;

a tube, said tube having a first end in fluid communication with said channel, said tube extending rearwardly from said toilet seat; and flexible tubing having a first end coupled to said tube, said flexible tubing having a second end coupled to said reservoir wherein said reservoir is in fluid communication with said channel, said tube having a second end coupled to said channel.

* * * * *